United States Patent [19]

Brenner et al.

[11] 4,035,146

[45] July 12, 1977

[54] BINDING OF ANTIMICROBIAL COMPOUNDS TO A HYDROXYL CONTAINING SUBSTRATE WITH CYANURIC CHLORIDE

[75] Inventors: Mortimer Wilkes Brenner, Scarsdale; Louis Laufer, New York, both of N.Y.

[73] Assignee: Schwarz Services International Ltd., Mount Vernon, N.Y.

[21] Appl. No.: 623,744

[22] Filed: Oct. 20, 1975

[51] Int. Cl.[2] ..... C14C 5/00

[52] U.S. Cl. ..... 8/94.21; 8/115.6; 8/190; 424/16; 424/25; 424/26; 424/181; 424/249; 424/326; 424/329; 424/362

[58] Field of Search ..... 424/181, 326, 329, 249, 424/362, 25, 26; 8/94.21, 190

[56] References Cited

PUBLICATIONS

Chemical Abstracts 76:60790m (1972).
Chemical Abstracts 60:6158c (1964).
Chemical Abstracts 58:10410h (1963).
American Assoc. of Textile Chemists & Colorists, "Antibacterial Finishes" No. 2, 1962.

*Primary Examiner*—Leonard Schenkman
*Attorney, Agent, or Firm*—St. Onge, Mayers, Steward & Reens

[57] ABSTRACT

Methods and compositions are disclosed for chemically bonding an antimicrobial compound to an hydroxyl bearing substrate such as cellulose, starches or leather. Cyanuric chloride (2, 4, 6 tri-chloro 1, 3, 5 triazine) is bonded to the substrate through the substrate hydroxyl and to the antimicrobial through an amine, guanido or quaternary ammonium group. The composition is:

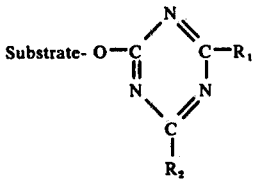

$R_1$ or $R_2$ may be chlorine or the same or different amine, guanido or quaternary ammonium containing antimicrobial. The bonding process is carried out in an aqueous solution having a pH of about 9 – 10.

5 Claims, No Drawings

BINDING OF ANTIMICROBIAL COMPOUNDS TO A HYDROXYL CONTAINING SUBSTRATE WITH CYANURIC CHLORIDE

BACKGROUND OF THE INVENTION

This invention relates to the chemical binding of anti-microbials onto a substrate bearing a hydroxyl group and particularly to substances such as cellulose, starches and leather.

The binding of antimicrobial substances to substrates such as textiles has been of interest for many years. Prior art efforts in this direction have not been entirely satisfactory because it has been difficult to attach the antimicrobial to the substrate and still have the antimicrobial retain biostatic or biocidal qualities. Further problems exist in that the antimicrobials of the prior art could generally be readily washed away from the treated substrate with water and/or with detergents.

It has been known to bond enzymes to a substrate through the use of cyanuric chloride, and in such cases the enzymes are immobilized. To our knowledge, however, antimicrobials have not been successfully chemically bonded to a substrate such as cellulose to resist repeated detergent washing and still retain inhibitory effort on the growth of microorganisms. Accordingly, it is an object of this invention to provide methods and compositions for the chemical bonding of antimicrobial compounds to substrates such as cellulose, starches, and leather which cannot be easily removed by washing with water and/or detergents.

The examples of some of the uses of antimicrobials chemically bonded to cellulose would be in the treatment of cloth used in hotels or hospitals for uniforms, bedding and the like, to prevent or minimize the presence of bacteria. The antimicrobials may also be bonded to bandages or bandage pads, to be used directly on superficial wounds, for example. Besides the use of the bonded antimicrobials on clothing in general, still other uses would be for diapers, and other undergarments. Further, the bonded antimicrobials may be used in industrial processes on filter media or on packaging and the like to maintain sterility or to reduce the number of undesirable microorganisms. The non-migrating, bonded antimicrobials are not absorbed into the human body when used on bedding, clothing, bandages or the like. When used on filter or packaging the surface, active antimicrobials will not contaminate the filtered or packaged substance. On leather, such as in shoes, the bound antimicrobial can provide built in resistance to fungi, molds and bacteria. When bound to starch, the antimicrobials can be readily mixed into body powders and the like. Thus, bonded non-migrating antimicrobials which could render surfaces sterile have substantial economic value.

Accordingly, it is an object of the invention to provide methods and compositions for chemically bonding antimicrobials to substrates.

It is a further object of the invention to provide methods and compositions as set forth above wherein the chemically bonded antimicrobial resists removal from the substrate by detergent washing.

The invention accordingly comprises the several steps and the relation of one or more of such steps with respect to each of the others, and the composition possessing the features, properties, and the relation of constituents, which are examplified in the following detailed disclosure, and the scope of the invention will be indicated in the claims.

Other objects of the invention will in part be obvious and will in part appear hereinafter.

SUMMARY OF THE INVENTION

The invention comprises the bonding of antimicrobials onto hydroxyl containing substrates such as cellulose, starches, or leather by reacting the hydroxyl groups of the substrate with cyanuric chloride and then reacting of amine, guanido or quaternary ammonium groups of the antimicrobials with the attached cyanuric chloride. The general reactions are believed to be as follows:

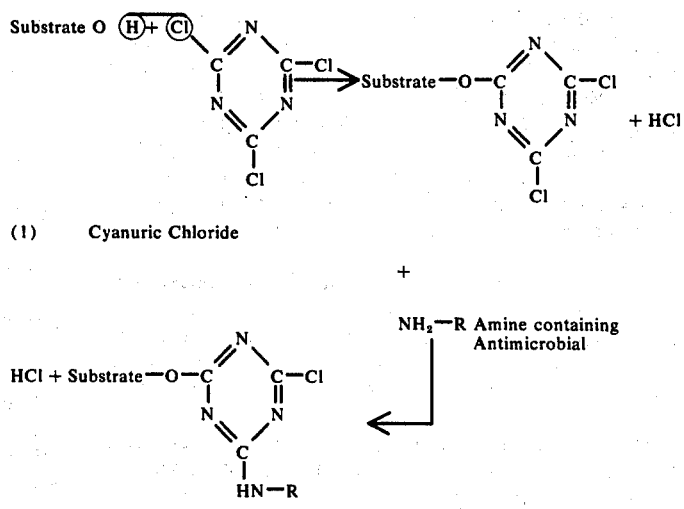

The reaction takes place in an aqueous alkaline solution such as a sodium hydroxide solution with a pH of about 9 to 10. The cyanuric chloride is preferably prepared in a solvent such as dioxane or acetone. The process is particularly useful in bonding antimicrobial compounds having amino groups to cellulosic substrates, such as cotton, rayon, cellulose acetate, etc.

The invention is effective in chemically bonding antimicrobials to hydroxyl containing substrates and particularly those antimicrobials having amine, guanido or quaternary ammonium hydroxyl groups. The cyanuric chloride bonds to the substrate and to the antimicrobial to provide chemical bonds which resist removal by detergent washing while maintaining inhibitory action against one or more microorganisms. It has also been found that cyanuric chloride itself has some inhibitory action against specific microorganisms.

SPECIFIC DESCRIPTION OF PREFERRED EMBODIMENT OF THE INVENTION

The chemical binding of antimicrobial or antiseptic compounds onto a hydroxyl containing substrate proceeds in accordance with the above reactions to form the composition:

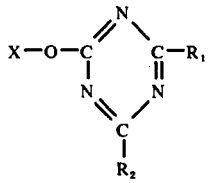

wherein X is the substrate which had contained the hydroxyl group, $R_1$ or $R_2$ may be chlorine or they may each be the same or a different amine, guanido or quarternary ammonium containing antimicrobial compound which is chemically bonded to the triazine ring through the nitrogen of the amine, guanido or quaternary ammonium group.

A number of amino, guanido or quaternary ammonium containing antimicrobials have been chemcially bonded to a cellulosic substrate, such as cotton, by cyanuric chloride. These are chlorhexidine acetate, streptomycin, trimethyl octyl decyl ammonium chloride, and mixtures of all three of these antimicrobials. Other substances which have been bound to a hydroxyl containing substrate are proflavine, bacitracin, tetracycline hydrochloride, neomycin sulfate, alkyldimethyl benzyl ammonium chloride and cetyl dimethyl benzyl ammonium chloride. Further, of the antimicrobials tested, the ones showing the strongest inhibition against the growth of *E. coli* were chlorhexidine acetate, streptomycin sulfate and neomycin sulfate as well as quaternary ammonium compounds such as alkyldimethyl benzyl ammonium chloride, trimethyl octyl decyl ammonium chloride and cetyl dimethyl benzyl ammonium chloride.

In bacteriological testing the bonded antimicrobials showed inhibitory action against *E. coil*, *Pseudomonas aeruginosa*, *Bacillus subtilis* and *Saccharomyces diastaticus*. It was also found that cyanuric chloride used alone has some inhibitory effect for specific microorganisms.

The bound antimicrobials, because of chemical bonding, showed substantial resistance to being washed from cotton fabric by several well-known laundry detergents.

In the above reactions the cyanuric chloride is bound to the hydroxyl bearing substrate through a carbon atom with hydrochloric acid formed as a reaction by-product. The amine, guanido or quaternary ammonium containing antimicrobial compound is then bound to the triazine ring of the cyanuric chloride, replacing one or both of the other chlorine atoms through the nitrogen of the antimicrobial, again producing hydrochloric acid as a by-product.

The cyanuric chloride or 2, 4, 6 tri-chloro-1, 3, 5, triazine is, for example, prepared as a 2.5% solution in dioxane or acetone as a solvent, and the pH of the solution is adjusted to between 9 and 10 with IN NaOH.

In the following examples of the invention the procedures for preparing the test samples shown in Tables 1 and 2 were as follows. A number of 1 inch square cotton patches were immersed in IN NaOH for about 15 minutes. The excess solution was poured off and the squares were washed with excess warm tap water (55° C.) to wash out the alkali. Then the washed squares were immersed in 2.5% solution of cyanuric chloride, prepared as above, again with the pH of the solution being adjusted to between 9 and 10 with IN NaOH. The cotton squares were permitted to stand in the cyanuric chloride solution for about 30 minutes. The excess cyanuric chloride solution was then poured off and the squares were washed twice with acetone containing 5% glacial acetic acid to stop any further reaction and to neutralize the alkalinity of the solution. The cotton patches were then washed two more times with acetone in order to remove any excess cyanuric chloride and were well rinsed with warm tap water. Some of the cotton patches were then air dried and analyzed for nitrogen by the Kjeldahl method.

A number of the cyanuric chloride treated cotton squares were then immersed in an aqueous solution of chlorhexidine (having 200 mg. of chlorhexidine diacetate per 100 ml. of solution) and the pH was adjusted to between 9 and 10 with IN NaOH. The cotton patches were stirred with the solution and permitted to stand overnight at room temperature, permitting reaction between the antimicrobial and the cyanuric chloride bound to the cotton. Other cotton patches were dipped into a streptomycin solution containing 200 mg. of streptomycin sulfate per 100 ml., and still other cotton patches were treated with a 0.5% aqueous solution of trimethyl octyl decyl ammonium chloride. The patches were all then removed from their respective solution, rinsed with large amounts of warm tap water at about 55° C. and air dried. A number of patches were then taken for further nitrogen analysis to determine the amount of antimicrobial compound which was bound to the cyanuric chloride. Using the nitrogen values and weight of the patches, the amounts of bound cyanuric chloride and bound antimicrobials were then calculated. These values are set forth in Tables below.

The inhibitory activity of the cotton squares with antimicrobial substances bound to them were tested against *Escherichia coli*, *Bacillus subtilis*, *Pseudomonas aeruginosa*, and *Saccharomyces diastaticus*. The inhibitory effect as to these microorganisms was determined in the following manner.

Cultures of each organism were grown in appropriate broths and then 1 ml. of each culture was diluted to 100 ml. with water. Two-tenths of a ml. of this suspension was pipetted onto a treated cotton square and allowed to stand at room temperature for about 15 minutes. Each square was placed in a petri dish and 20 ml. of water added and stirred to re-suspend organisms of inoculating culture. Then 1 ml. and 0.1 ml. samples of that suspension were placed onto a nutrient agar plate. After 24 hours of incubation at 30° C. the colonies on the plate were counted. An untreated cotton square or ones treated only with sodium hydroxide or cyanuric chloride were similarly processed as controls. Those cotton squares which showed less than 10% of the number of colonies obtained with the controls are considered to be inhibitory.

In the following Tables the cotton patches to which antimicrobials are bound through cyanuric chloride were tested for retention of antimicrobial action after washing. For such testing the following procedure was employed. After 18 hours of immersion in antimicrobial solution the cotton patches were removed, well rinsed with warm water, and placed in a detergent solution of about 1 gm. of detergent per liter of solution. The patches were then stirred in the detergent for about 10 minutes, the detergent is poured off and the cotton was well washed again with warm tap water at about 55° C. Such washing with detergent followed by a warm water rinse was repeated two more times and finally the patches were air dried and tested as described above for their microbial inhibitory activity against the organisms shown in the following Tables.

In the Tables the following abbreviations are used:

C = *Cyanuric Chloride* (2, 4, 6 trichloro 1, 3, 5 triazine)

M.W. = 184.5, N = 22.7%. Prepared as a 2.5% solution in either dioxane or acetone.

CHA = Chlorhexidine: Formula in Merck Index, Eighth Edition, 1968, p. 236. M.W. = 505.5, N = 27.7%. Prepared in a concentration of 200 mg. as chlorhexidine acetate per 100 ml. of $H_2O$ — pH = about 9.0. pH adjusted to 10 before use.

SPM = Streptomycin: Formula in Merck Index, Eighth Edition, 1968, p. 984–5. M.W. 736.58, N = 13.3%. Prepared in a concentration of 200 mg. as streptomycin sulfate per 100 ml. of $H_2O$ — pH about 5.0. pH adjusted to 9 – 10 before use.

AQR = Arquard 18 – 50: 50% aqueous solution of trimethyl octyl decyl ammonium choride — $C_{18}H_{39}N\ (CH_3)_3Cl$ — M.W. = 350.0, N = 4.0%. Prepared in a concentration of 2 ml. in 200 ml. of $H_2O$. pH about 5.8. pH adjusted to 9 – 10 with 1N NaOH before use.

DM = A mixed solution (dilute) of CHA (133 mg.), SPM (133 mg.) and AQR (0.67 ml.) in 200 ml. of water adjusted to pH 9.0 to 10.0.

CM = A mixed solution (concentration of CHA (400 mg.) SPM (400 mg.), and AQR (2.0 ml.) in 200 ml. of water adjusted to pH 9.0 to 10.0.

A = All: A retail packaged detergent used in clothes washing machines. Label states that All contains surfactants, sodium carbonate, sodium silicate, bleach, borax, and brighteners. It is used in concentration of 1 g. per liter (pH about 10). It is biodegradable, contains no phosphorous and is manufactured by Lever Brothers Co., New York, N.Y.

T = Tide: A retail detergent used in clothes washing machines. Label states that Tide contains anionic surfactants, sodium carbonate, sodium silicate, sodium sulfate, fabric whitener, and perfume. Used in concentration of 1 g. per liter (pH about 10). It is biodegradable and is manufactured by Proctor & Gamble, Cincinnati, Ohio.

J = Joy: A retail washing liquid used for washing dishes and contains anionic and nonionic surfactants, ethyl alcohol as a stabilizing agent, and perfume. Used in concentration of 1 g. per liter (pH 7.3). It contains no phosphorous and is manufactured by Proctor & Gamble, Cincinnati, Ohio.

TNTC: Too numerous to count.

Examples:

C-CHA-T — Indicates cotton treated with cyanuric chloride (C), followed by reaction with chlorhexidine acetate (CHA), followed by washing with Tide (T).

C-A — Indicates cotton treated with cyanuric chloride (C), followed by washing with All (A).

NaOH — Indicate cotton washed with 1N NaOH for 15 minutes followed by water wash to remové excess NaOH.

CHA-J — Indicates cotton treated with chlorhexidine acetate (no binding with cyanuric chloride) followed by washing with Joy.

In the Tables, calculations were made on the following molecular weights and nitrogen contents of the compounds employed:

| Antimicrobial | Molecular Weight | % Nitrogen |
|---|---|---|
| C-Cyanuric Chloride | 184.5 | 22.7 |
| CHA-Chlorhexidine | 505.6 | 27.7 |
| SPM-Streptomycin | 581.6 | 16.86 |
| AQR-Arquad 18–50 | 350 | 4.0 |

Cotton patches were prepared as above and the results of testing of the cyanuric-antimicrobial treated cotton for inhibition of microbiological growth are set forth in Tables 1(*a*), (*b*), (*c*) and (*d*).

TABLE 1(a)

| Bacteriological Results — Inhibition Against *E. coli* Controls | Dilution | |
|---|---|---|
| | 1 ml | 0.1 ml |
| NaOH | TNTC | 1335 |
| C-$H_2O$ | TNTC | 699 |
| C-J | 55 | 7 |
| C-A | TNTC | 207 |
| C-T | TNTC | 218 |
| Unbound Antimicrobials | | |
| CHA-$H_2O$ | 0 | 0 |
| CHA-J | TNTC | 365 |
| CHA-T | 9 | 0 |
| Bound Antimicrobials | | |
| C-CHA-$H_20$ | 2 | 0 |
| C-CHA-J | TNTC | 365 |
| C-CHA-A | 289 | 25 |
| C-CHA-T | TNTC | 307 |
| C-SPM-$H_2O$ | 3 | 0 |
| C-SPM-J | 3 | 0 |
| C-SPM-A | 0 | 0 |
| C-SPM-T | 2 | 0 |
| C-AQR-$H_2O$ | 18 | 1 |
| C-AQR-J | TNTC | 382 |
| C-AQR-A | 317 | 30 |
| C-AQR-T | TNTC | 220 |

TABLE 1(b)

| Bacteriological Results — Inhibition Against *B. subtilis* Controls | Dilution | |
|---|---|---|
| | 1 ml | 0.1 ml |
| NaOH | 3 | 0 |
| C-$H_2O$ | 278 | 31 |
| C-J | 0 | 0 |
| C-A | 9 | 0 |
| C-T | 1 | 0 |
| Unbound Antimicrobials | | |
| CHA-$H_2O$ | 4 | 0 |
| CHA-J | 0 | 0 |
| CHA-T | 0 | 0 |
| Bound Antimicrobials | | |
| C-CHA-$H_2O$ | 7 | 0 |
| C-CHA-J | 0 | 0 |
| C-CHA-A | 7 | 0 |
| C-CHA-T | 0 | 0 |
| C-SPM-$H_20$ | 6 | 0 |
| C-SPM-J | 0 | 0 |
| C-SPM-A | 0 | 0 |
| C-SPM-T | 11 | 0 |
| C-AQR-$H_2O$ | 5 | 0 |
| C-AQR-J | 3 | 0 |
| C-AQR-A | 2 | 0 |
| C-AQR-T | 4 | 0 |

TABLE 1(c)

| Controls | Bacteriological Results — Inhibition Against *Pseudomonas aeruginosa* Dilution 1 ml | 0.1 ml |
|---|---|---|
| NaOH | TNTC | TNTC |
| C-$H_2O$ | TNTC | 1980 |
| C-J | TNTC | 427 |
| C-A | TNTC | TNTC |
| C-T | TNTC | 508 |
| Unbound Antimicrobials | | |
| CHA-$H_2O$ | 206 | 26 |
| CHA-J | TNTC | 294 |
| CHA-T | TNTC | 763 |
| Bound Antimicrobials | | |
| C-CHA-$H_2O$ | 11 | 0 |
| C-CHA-J | TNTC | 294 |
| C-CHA-A | TNTC | 508 |
| C-CHA-T | >300 | 68 |
| C-SPM-$H_2O$ | TNTC | 381 |
| C-SPM-J | TNTC | 572 |
| C-SPM-A | TNTC | 345 |
| C-SPM-T | TNTC | TNTC |
| C-AQR-$H_2O$ | 136 | 18 |
| C-AQR-J | >300 | 210 |
| C-AQR-A | >300 | 41 |
| C-AQR-T | 61 | 7 |

TABLE 1(d)

| Controls | Bacteriological Results — Inhibition Against *S. diastaticus* Dilution 1 ml | 0.1 ml |
|---|---|---|
| NaOH | 42 | 5 |
| C-$H_2O$ | TNTC | 50 |
| C-J | >300 | 31 |
| C-A | 64 | 7 |
| C-T | 66 | 8 |
| Unbound Antimicrobials | | |
| CHA-$H_2O$ | 19 | 4 |
| CHA-J | 148 | 12 |
| CHA-T | >300 | 27 |
| Bound Antimicrobials | | |
| C-CHA-$H_2O$ | 1 | 0 |
| C-CHA-J | 148 | 12 |
| C-CHA-A | 2 | 0 |
| C-CHA-T | 16 | 2 |
| C-SPM-$H_2O$ | 17 | 1 |
| C-SPM-J | 47 | 4 |
| C-SPM-A | 41 | 2 |
| C-SPM-T | 1 | 0 |
| C-AQR-$H_2O$ | 0 | 0 |
| C-AQR-J | 0 | 0 |
| C-AQR-A | 0 | 0 |
| C-AQR-T | 0 | 0 |

TABLE 1(e)

Milligrams of Nitrogen per Gram of Cotton Expressed as Cyanuric Chloride and Antimicrobials

| Sample | Mg. N per g. of Cotton | Mg. N per g. Cotton (Corrected for NaOH Blank | Mg. N per g. Cotton (Corrected for C) | Mg. Anti-microbial per g. Cotton |
|---|---|---|---|---|
| NaOH | 0.25 | | | |
| C-$H_2O$ | 9.09 | 8.84 | | 39.0 |
| C-J | 8.45 | 8.20 | | 36.1 |
| C-A | 8.35 | 8.10 | | 35.6 |
| C-T | 7.42 | 7.17 | | 31.6 |
| C-AQR-J | 8.87 | 8.62 | 0.40 | 10.0 |
| C-AQR-A | 10.33 | 10.08 | 1.98 | 49.6 |
| C-AQR-T | 9.92 | 9.77 | 1.60 | 40.0 |
| C-AQR-$H_2O$ | 9.32 | 9.07 | 0.23 | 5.8 |
| C-SPM-J | 11.65 | 11.40 | 3.20 | 19.0 |
| C-SPM-A | 10.06 | 9.81 | 1.71 | 10.1 |
| C-SPM-T | 15.36 | 15.11 | 7.94 | 47.1 |
| C-SPM-$H_2O$ | 11.57 | 11.32 | 2.48 | 14.7 |
| C-CHA-J | 16.65 | 16.40 | 8.20 | 29.6 |
| C-CHA-A | 18.05 | 17.80 | 9.70 | 35.0 |
| C-CHA-T | 14.73 | 14.48 | 7.31 | 26.4 |
| C-CHA-$H_2O$ | 14.80 | 14.55 | 5.71 | 20.6 |
| CHA-J | 0.85 | 0.60 | | 2.16 |
| CHA-T | 0.91 | 0.66 | | 2.38 |

TABLE 1(e)-continued

Milligrams of Nitrogen per Gram of Cotton Expressed as Cyanuric Chloride and Antimicrobials

| Sample | Mg. N per g. of Cotton | Mg. N per g. Cotton (Corrected for NaOH Blank | Mg. N per g. Cotton (Corrected for C) | Mg. Anti-microbial per g. Cotton |
|---|---|---|---|---|
| CHA-$H_2O$ | 0.97 | 0.72 | | 2.60 |

The bacteriological results for inhibitory activity against the four microorganisms in Tables 1(*a*), (*b*), (*c*) and (*d*) may be summarized as follows. The controls in which cyanuric chloride alone was bound to cotton (followed by washing with water and detergents) showed little or no inhibition of growth against *E. coli*, *Pseudomonas aeruginosa* and *S. diastaticus*, but showed substantial effectiveness against *B. subtilis* growth in the test results set forth in Tables 1(*a*), (*b*), (*c*) and (*d*). As will be noted, *B. subtilis* growth was inhibited on all treated and untreated cotton patches. It is believed that either the culture used was weak or the number of organisms used was too small. The experiment was repeated using a heavier inoculum of *B. subtilis* and showed less inhibition of *B. subtilis* by cyanuric chloride alone, as shown in Table 2(*a*) below.

Two of the antimicrobials, namely chlorhexidine (CHA) and streptomycin (SPM), after binding to cotton were ineffective in preventing the growth of *Pseudomonas aeruginosa*, particularly after the cotton was washed with detergents. In one instance chlorhexidine showed some inhibition against *Pseudomonas aeruginosa* after only a water wash. Trimethyl octyl decyl ammonium chloride (AQR) showed the best relative results against this microbe after the cotton patches were washed with water and detergents. A repetition of the experiments as to *Pseudomonas aeruginosa*, as shown in Table 2(*b*), generally confirms these results.

In Table 1(*a*) cotton treated with chlorhexidine alone followed by water washing and Tide detergent is shown to have inhibitory activity against *E. coli*. Further, the chlorhexidine could not be completely washed out of the cotton.

Table 1(*e*) shows the extent of antimicrobial bonding by analysis for nitrogen by the Kjeldahl method. As shown in Table 1((*e*), some of the chlorhexidine was directly bound to the cotton (lines 25–27). The inhibiting effect of chlorhexidine against *E. coli* was thus somewhat affected by detergent washing. Trimethyl octyl decyl ammonium chloride also shows a reduction of inhibitory effect on E. coli after detergent washing. Streptomycin showed excellent inhibition of *E. coli* growth in all tests even after extensive washing with water and detergents. Generally, streptomycin and chlorhexidine showed about 70 to 90% inhibition of *S. diastaticus* growth. Trimethyl octyl decyl ammonium chloride was completely inhibitory in all the experiments against *S. diastaticus*.

Thus, these above antimicrobials have been shown to be chemically bound to cotton via reaction with cyanuric chloride and are useful to inhibit the growth of four different classes of microorganisms even after extensive washing of the treated cottons with water and three commonly used commercially available detergents.

The tests were repeated for further study of inhibitory activity against *B. subtilis* and *Pseudomonas aeru-*

*ginosa* and the results are shown in Tables 2(*a*) and (*b*).

TABLE 2(a)

| Controls | Bacteriological Results — Inhibition Against *B. subtilis* Dilution | |
|---|---|---|
| | 1 ml | 0.1 ml |
| C-$H_2O$ | 31 | 5 |
| C-$H_2O$-J | 35 | 5 |
| C-$H_2O$-A | 14 | 1 |
| C-$H_2O$-T | 78 | 7 |
| Bound Antimicrobials | | |
| C-CHA-$H_2O$ | 0 | 0 |
| C-CHA-J | 11 | 2 |
| C-CHA-A | 10 | 3 |
| C-CHA-T | 4 | 1 |
| C-SPM-$H_2O$ | 63 | 8 |
| C-SPM-J | 18 | 3 |
| C-SPM-A | 121 | 18 |
| C-SPM-T | 20 | 4 |
| C-AQR-$H_2O$ | 0 | 0 |
| C-AQR-J | 13 | 2 |
| C-AQR-A | 0 | 0 |
| C-AQR-T | 72 | 0 |
| C-CM-$H_2O$ | 0 | 0 |
| C-CM-J | 1 | 0 |
| C-CM-A | 25 | 2 |
| C-CM-T | 2 | 0 |
| C-DM-$H_2O$ | 0 | 0 |
| C-DM-J | 72 | 12 |
| C-DM-A | 0 | 0 |
| C-DM-T | 2 | 1 |

TABLE 2(b)

| Controls | Bacteriological Results — Inhibition Against *Pseudomonas aeruginose* Dilution | |
|---|---|---|
| | 1 ml | 0.1 ml |
| C-$H_2O$ | 300 | 387 |
| C-$H_2O$-J | TNTC | 636 |
| C-$H_2O$-A | TNTC | TNTC |
| C-$H_2O$-T | TNTC | TNTC |
| Bound Antimicrobials | | |
| C-CHA-$H_2O$ | 24 | 1 |
| C-CHA-J | >300 | 87 |
| C-CHA-A | 274 | 20 |
| C-CHA-T | >300 | 41 |
| C-SPM-$H_2O$ | >300 | 158 |
| C-SPM-J | >300 | 508 |
| C-SPM-A | >300 | 94 |
| C-SPM-T | >300 | 207 |
| C-AQR-$H_2O$ | 0 | 0 |
| C-AQR-J | >300 | 84 |
| C-AQR-A | >300 | 179 |
| C-AQR-T | >300 | 182 |
| C-CM-$H_2O$ | 0 | 0 |
| C-CM-J | >300 | 91 |
| C-CM-A | 2 | 1 |
| C-CM-T | >300 | 62 |
| C-DM-$H_2O$ | >300 | 187 |
| C-DM-J | >300 | 224 |
| C-DM-A | >300 | 157 |
| C-DM-T | >300 | 178 |

The results shown in Tables 2(*a*) and (*b*) further illustrate the inhibition of microorganism growth of *Bacillus subtilis* and *Pseudomonas aeruginosa* by chlorhexidine (CHA), streptomycin (SPM), trimethyl octyl decyl ammonium chloride (AQR), and dilute mixtures (DM) and concentrated mixtures (CM) of all three of these antimicrobials.

In the experiments shown in Table 2(*a*), a heavier inoculum of *B. subtilis* was used and inhibition of *B. subtilis* by chlorhexidine and trimethyl octyl decyl ammonium chloride is clearly shown. Detergent washing as well as the concentration of the organism slightly affected the inhibitory properties of these chemically bound antimicrobials.

A dilute mixture of all three antimicrobials (DM) shows good inhibition of growth of *B. subtilis* even after extensive washing with water and detergents. It has been found that use of a more concentrated solution (CM) of antimicrobial compounds shows even greater inhibition against *B. subtilis when bound to cotton regardless of the type of washing which is used.*

Chlorhexidine and trimethyl octyl decyl ammonium chloride show good inhibition toward *Pseudomonas aeruginosa* when the cotton was washed only with water. There was less inhibitory effect when the cotton was washed with detergents, confirming the results shown in Table 1(*c*). The dilute mixture (DM) and streptomycin showed the least effectiveness against *Pseudomonas aeruginosa*. The best results were obtained by a concentrated mixture (CM) of all three antimicrobials in the inhibition of *Pseudomonas aeruginosa* growth.

Tables 2(*a*) and (*b*) show that good inhibition of growth of *B. subtilis* and *Pseudomonas aeruginosa* can be obtained when these organisms are exposed to cotton treated with chlorhexidine or trimethyl octyl decyl ammonium chloride or mixtures of these two antimicrobials in the proper concentrations. Cyanuric chloride alone had some inhibitory effect against *B. subtilis*, but little effect against *Pseudomonas aeruginosa*.

As shown in Table 2(*c*), the nitrogen values again show substantial antimicrobial bonding to the cotton.

TABLE 2(c)

Milligrams of Nitrogen per Gram of Cotton Expressed as Cyanuric Chloride and Antimicrobials

| Sample | Mg. N per g. of Cotton | Mg. n per g. Cotton (Corrected for NaOH Blank) | Mg. N per g. Cotton (Corrected for C) | Mg. Anti-microbial per g. Cotton |
|---|---|---|---|---|
| NaOH | 0.25 | | | |
| C-$H_2O$ | 8.45 | 8.20 | | 36.1 |
| C-AQR-J | 9.28 | 9.03 | 0.83 | 20.7 |
| C-AQR-T | 9.68 | 9.43 | 1.23 | 30.8 |
| C-SPM-T | 11.77 | 11.52 | 3.32 | 19.7 |
| C-CHA-J | 16.26 | 16.01 | 7.81 | 28.2 |
| C-CHA-T | 14.87 | 14.62 | 6.42 | 23.2 |
| C-CM-J | 15.13 | 14.98 | 6.78 | 38.6 |
| C-CM-A | 14.08 | 13.83 | 5.63 | 32.1 |
| C-CM-T | 16.40 | 16.15 | 7.95 | 45.3 |
| C-CM-$H_2O$ | 14.7 | 13.92 | 5.72 | 32.6 |
| C-DM-J | 12.77 | 12.52 | 4.32 | 24.6 |
| C-DM-A | 13.33 | 13.08 | 4.88 | 27.8 |
| C-DM-T | 13.61 | 13.36 | 5.16 | 29.4 |
| C-DM-$H_2O$ | 12.20 | 11.95 | 3.75 | 21.4 |

In further work done, the antimicrobials were bound onto insoluble starch by cyanuric chloride. The antimicrobials were applied in unbound and bound form on a starch powder which after exposure to the cyanuric chloride and the antimicrobials, was well washed with water, followed by an acetone rinse to remove excess reagent and to then permit air drying. It is indicated that chlorhexidine acetate (CHA) and streptomycin (SPM) are adsorbed onto the starch and are not completely removed by water washing since they exhibit good antimicrobial activity without being chemically bound with cyanuric chloride. Arquad 18–50 (AQR) also exhibited some adsorption onto the starch, but is shown to be effective against *E. coli* only when bound via cyanuric chloride.

The antimicrobials, streptomycin, chlorhexidine acetate and Arquad 18–50 have also been bound onto leather (cowhide) via cyanuric chloride. In the case of chlorhexidine acetate and Arquad 18–50, these antimicrobials appear to be as effective unbound as when bound by cyanuric chloride, since there is substantial adsorption of these antimicrobials onto the leather. In the case of streptomycin, however, there appears to be little adsorption of the SPM onto the leather and when bound to leather by cyanuric chloride, it is indicated that streptomycin has substantial antimicrobial activity against *B. subtilis* and *S. diastaticus*.

In later work, to examine the necessity for the use of acetone or dioxane solvents for cyanuric chloride, an aqueous solution at a pH of about 9–10 was used and the concentration of cyanuric chloride was reduced from 2.5% to 1%. In two different sets of experiments the time of reaction of the antimicrobials with the cyanuric chloride was reduced from 18 hours to one hour, as shown in Tables 3 (*a*), (*b*), (*c*) and (*d*). From these Tables the results lead to the conclusion that the cyanuric chloride can be bound to a substrate (in this case, cotton squares, as for the Tables 1 (*a*), (*b*), (*c*) and (*d*) above) in an aqueous alkaline solution and that the concentration of cyanuric chloride may be substantially reduced when it is to be used as a binding agent only, in most cases.

The reduction of reaction time of the antimicrobials from 18 hours to one hour indicates that a substantial amount of the antimicrobial is bound to the cyanuric chloride within the first hour of the reaction and that additional reaction time does not add much more antimicrobial material. Accordingly, it should be concluded that reaction time of the antimicrobials need be no more than an hour, except in those cases where an absolute maximum of antimicrobial bound onto the substrate is required. The reaction time is indicated by the number suffix 1 or 18 in the Tables.

TABLE 3(a)

Bacteriological Results — Inhibition Against *E. coli*

| Controls | Dilution 1 ml | Dilution 0.1 ml |
|---|---|---|
| NaOH | TNTC | TNTC |
| C | TNTC | TNTC |
| Unbound Antimicrobials | | |
| AQR-1 | TNTC | 250 |
| AQR-18 | TNTC | 500 |
| CHA-1 | 500 | 64 |
| CHA-18 | TNTC | 166 |
| SPM-1 | 107 | 21 |
| SPM-18 | 23 | 2 |
| Bound Antimicrobials | | |
| C-AQR-1 | 18 | 4 |
| C-AQR-18 | TNTC | 171 |
| C-CHA-1 | 12 | 1 |
| C-CHA-18 | 8 | 2 |
| C-SMP-1 | 14 | 2 |
| C-SPM-18 | 57 | 8 |

Table 3(b)

Bacteriological Results — Inhibition Against *B. subtilis*

| Controls | Dilution 1 ml | Dilution 0.1 ml |
|---|---|---|
| NaOH | 148 | 16 |
| C | 264 | 24 |
| Unbound Antimicrobials | | |
| AQR-1 | 0 | 0 |
| AQR-18 | 0 | 0 |
| CHA-1 | 1 | 0 |
| CHA-18 | 0 | 0 |
| SPM-1 | 65 | 5 |
| SPM-18 | 14 | 2 |
| Bound Antimicrobials | | |
| C-AQR-1 | 0 | 0 |
| C-AQR-18 | 0 | 0 |
| C-CHA-1 | 0 | 0 |
| C-CHA-18 | 0 | 0 |
| C-SPM-1 | 31 | 3 |
| C-SPM-18 | 7 | 0 |

TABLE 3(c)

Bacteriological Results — Inhibition Against *Pseudomonas aeruginosa*

| Controls | Dilution 1 ml | Dilution 0.1 ml |
|---|---|---|
| NaOH | TNTC | TNTC |
| C | TNTC | TNTC |
| Unbound Antimicrobials | | |
| AQR-1 | TNTC | 127 |
| AQR-18 | 320 | 45 |
| CHA-1 | TNTC | 380 |
| CHA-18 | TNTC | 79 |
| SPM-1 | TNTC | 320 |
| SPM-18 | TNTC | 310 |
| Bound Antimicrobials | | |
| C-AQR-1 | TNTC | 167 |
| C-AQR-18 | 174 | 26 |
| C-CHA-1 | TNTC | 420 |
| C-CHA-18 | TNTC | 84 |
| C-SPM-1 | TNTC | 624 |
| C-SPM-18 | TNTC | 87 |

TABLE 3(d)

Bacteriological Results — Inhibition Against *S. diastaticus*

| Controls | Dilution 1 ml | Dilution 0.1 ml |
|---|---|---|
| NaOH | TNTC | 106 |
| C | 570 | 61 |
| Unbound Antimicrobials | | |
| AQR-1 | 0 | 0 |
| AQR-18 | 2 | 0 |
| CHA-1 | 54 | 6 |
| CHA-18 | 37 | 4 |
| SPM-1 | 810 | 95 |
| SPM-18 | 112 | 13 |
| Bound Antimicrobials | | |
| C-AQR-1 | 0 | 0 |
| C-AQR-18 | 3 | 1 |
| C-CHA-1 | 15 | 1 |
| C-CHA-18 | 28 | 3 |
| C-SPM-1 | 440 | 54 |
| C-SPM-18 | 82 | 9 |

TABLE 3(e)

Milligrams of Nitrogen per Gram of Cotton Expressed as Cyanuric Chloride and Antimicrobials

| Sample | Mg. N. per g. of Cotton | Corrected for NaOH Blank Mg. N. per g. Cotton | Mg. Antimicrobial per g. Cotton |
|---|---|---|---|
| NaOH | 0.44 | | |
| AQR-1 | 0.66 | 0.22 | 5.5 |
| CHA-1 | 1.41 | 0.97 | 3.5 |
| SPM-1 | 0.54 | 0.10 | 0.53 |
| AQR-18 | 0.87 | 0.43 | 10.0 |
| CHA-18 | 1.66 | 1.22 | 4.4 |
| SPM-18 | 0.86 | 0.42 | 2.5 |
| C | 2.24 | 1.80 | 8.0 |
| C-AQR-1 | 2.42 | 1.98 | 4.5 |
| C-CHA-1 | 3.46 | 3.02 | 4.4 |
| C-SPM-1 | 2.73 | 2.29 | 2.9 |
| C-AQR-18 | 2.46 | 2.02 | 5.4 |
| C-CHA-18 | 3.72 | 3.28 | 5.3 |
| C-SPM-18 | 2.99 | 2.55 | 4.4 |

Notes:
C = Cyanuric Chloride - 1% aqueous solution pH 9 – 10.
AQR-1 = Exposure to AQR of one hour.
AQR-18 = Exposure to AQR of eighteen hours.

The results shown in Tables 3(*a*), (*b*), (*c*) and (*d*) indicate that the inhibition of *E. coli* is enhanced by the binding of the antimicrobials through cyanuric chloride. In the case of *B. subtilis*, the unbound antimicrobials, as well as the bound antimicrobials, inhibited growth of that organism, but it should be noted that in all of the experiments shown in Tables 3(*a*), (*b*), (*c*) and (*d*), a water wash only was used. *Pseudomonas aeruginosa* was somewhat inhibited by the bound and unbound AQR and it was measurably affected by an 18 hour exposure of antimicrobial rather than the one hour treatment. Accordingly, for difficult to inhibit microorganisms such as *Pseudomonas aeruginosa*, it is recommended that a maximum of antimicrobial be employed by the use of a more concentrated solution of cyanuric chloride as the binding agent and by a more extensive exposure of antimicrobial to the cyanuric chloride treated substrate.

*S. diastaticus* was inhibited by both bound and unbound AQR and CHA, while bound SPM somewhat inhibited the growth of *S. distaticus*. Again, the extended exposure of the antimicrobial over 18 hours has a marked effect on the inhibition of S. diastaticus.

From the Tables 3(*a*), (*b*), (*c*) and (*d*), it is also indicated that the cyanuric chloride alone when used in a 1% aqueous solution was not as antimicrobial as that used for the Tables 1, wherein a 2.5% solution in dioxane was used.

Table 3(*e*) shows the milligrams of antimicrobial per gram of cotton deposited or bound on the substrate as determined by the Kjeldahl method. As shown in Table 3(*e*), there was only about 8 mg. of cyanuric chloride per gram of cotton bound to the substrate as compared to from 31.6 to 39 mg. of cyanuric chloride per gram of cotton as shown in Table 1(*e*). Accordingly, the binding of cyanuric chloride to the cellulosic substrate appears to be proportional to the concentration of the cyanuric chloride solution used. As the concentration of cyanuric chloride increased, the antimicrobial effect of the cyanuric chloride comes apparent.

In early work done the results showed that cyanuric chloride when used in a concentration of 2.5% substantially inhibited growth of *E. coli*. When chlorhexidine acetate, streptomycin and Arquad 18-50 were bound to the cotton substrate via cyanuric chloride, the results were inconclusive. In general, the chlorhexidine acetate, whether washed with water or commercial detergents showed complete inhibition of *E. coli* and the streptomycin nearly complete inhibition. The Arquad 18–50, however, only showed complete inhibition when washed with All and very poor inhibition when washed with Joy or Tide.

Attempts to chemically bond antimicrobials with cyanuric fluoride indicate that the amount of cyanuric fluoride which would bond to the cotton was substantially less than the cyanuric chloride bound under the same experimental conditions. Accordingly, the amount of antimicrobial that could be bound to a cellulosic substrate by cyanuric floride was also substantially less, i.e. in the order of about 20% of that which could be bonded via cyanuric chloride.

It has also been found that a fresh solution of cyanuric chloride is more effective than aged solutions. Accordingly, it is recommended that the cyanuric chloride be used within 24 hours after being prepared to assure maximum bonding to the substrate.

The method and composition of the invention thus provide antimicrobial surfaces for a variety of uses wherein persistence, but non-migrating antimicrobial action, is necessary or desirable. The chemical bonding of the antimicrobial to the substrate provides resistance to removal by washing and accordingly, is particularly suitable for use on clothing, bedding, bandages, filters, packaging, shoes, powders, and a number of other applications. Chemical bonding of the antimicrobial to the substrate also prevents ingestion or other undesirable removal of the antimicrobial from the substrate.

It will thus be seen that the objects set forth above, among those made apparent from the preceding description, are efficiently attained and, since certain changes may be made in carrying out the above process and in the composition set forth without departing from the scope of the invention, it is intended that all matter contained in the above description shall be interpreted as illustrative and not in a limiting sense.

What is claimed is:

1. The method of bonding an amine, quanido or quaternary ammonium containing antimicrobial compound selected from the group consisting of chlorhexidine acetate, streptomycin sulfate, neomycin sulfate, alkyl dimethyl benzyl ammonium chloride, trimethyl octyl decyl ammonium chloride, cetyl dimethyl benzyl ammonium chloride and mixtures thereof to a hydroxyl containing substrate taken from the group consisting of cellulose, starches and leather comprising the steps of:

A. reacting the substrate with cyanuric chloride in a solution to chemically bond the cyanuric chloride to the substrate;

B. and then reacting an effective amount of antimicrobial in solution with the cyanuric chloride on the substrate to chemically bond the cyanuric chloride to the antimicrobial, said cyanuric chloride being present in an amount effective to bond the antimicrobial to the substrate through the cyanuric chloride.

2. The method of bonding an amine, quanido or quaternary ammonium containing antimicrobial substance to a hydroxyl containing substrate as defined in claim 1 wherein the solution is alkaline and has as pH of from 9 to 10.

3. An antimicrobial composition comprising a hydroxyl containing substrate to which is bound cyanuric chloride and one or more amine, guanido or quaternary ammonium containing antimicrobial compounds selected from the group consisting of chlorhexidine acetate, streptomycin sulfate, neomycin sulfate, trimethyl octyl decyl ammonium chloride, alkyl dimethyl benzyl ammonium chloride, cetyl dimethyl benzyl ammonium chloride, and mixtures thereof, said antimicrobial compound being chemically bonded to the hydroxyl containing substrate through the cyanuric chloride.

4. The antimicrobial composition defined in claim 3 wherein said hydroxyl containing substrate is selected from the group consisting of cellulose, starches and leather.

5. A persistent antimicrobial composition comprising a cellulose substrate having chemically bound thereto a cyanuric chloride radical and one or more amine, guanido or quaternary ammonium containing antimicrobial radicals chemically bound to said cyanuric chloride radical to provide a composition of the formula

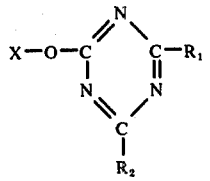

wherein X is the substrate, $R_1$ or $R_2$ may be chlorine, and one or each of $R_1$ and $R_2$ is an antimicrobial radical, either the same or different, selected from the group consisting of chlorhexidine acetate, streptomycin, trimethyl octyl decyl ammonium chloride, bacitracin, tetracycline hydrochloride, neomycin sulfate, alkyldimethyl benzyl ammonium chloride and cetyl dimethyl benzyl ammonium chloride.

* * * * *

UNITED STATES PATENT OFFICE
CERTIFICATE OF CORRECTION

PATENT NO. : 4,035,146

DATED : July 12, 1977

INVENTOR(S) : Mortimer Wilkes Brenner and Louis Laufer

It is certified that error appears in the above-identified patent and that said Letters Patent are hereby corrected as shown below:

Column 1, line 68, after "filter" insert --media--;
Column 2, line 1, delete comma "," after "surface";
line 20, "examplified" should be --exemplified--;
Column 3, line 8, "EMBODIMENT" should be --EMBODIMENTS--;
line 68, "IN" should be --lN--;
Column 4, line 4, "IN" should be --lN--;
line 6, delete "excess";
line 10, "IN" should be --lN--;
line 26, "IN" should be --lN--;
Column 5, line 8, "is" should be --was--;
line 16, "Cyanuric Chloride" should not be italicized;
line 30, "Arquard" should be --Arquad--;
line 39, "(concentration" should be --(concentrated)--
Column 6, line 3, "Indicate" should be --Indicates--;
line 27, "Controls" in Table 1(a) should be directly above "NaOH";
line 49, "Controls" in Table 1(b) should be directly above "NaOH";
Column 7, line 4, "Controls" in Table 1(c) should be directly above "NaOH";
line 27, "Controls" in Table 1(d) should be directly above "NaOH";
lines 48 and 49, Heading "Milligrams of Nitrogen per Gram of Cotton Expressed as Cyanuric Chloride and Antimicrobials" should be --Cyanuric Chloride and Antimicrobials Expressed as Milligrams of Nitrogen per Gram of Cotton--;
line 54, after "Blank" insert --)--;
Column 8, lines 2 and 3, Heading "Milligrams of Nitrogen per Gram of Cotton Expressed as Cyanuric Chloride and Antimicrobials" should be --Cyanuric Chloride

UNITED STATES PATENT OFFICE
CERTIFICATE OF CORRECTION

PATENT NO. : 4,035,146
DATED : July 12, 1977
INVENTOR(S) : Mortimer Wilkes Brenner and Louis Laufer It is certified that error appears in the above-identified patent and that said Letters Patent are hereby corrected as shown below:

| | | |
|---|---|---|
| | | and Antimicrobials Expressed as Milligrams of Nitrogen per Gram of Cotton--; |
| Column 8, | line 8, | after "Blank" insert --)--; |
| | line 48, | delete "(lines 25-27)"; |
| | line 52, | "E. coli" should be italicized; |
| Column 9, | line 5, | "Controls" in Table 2(a) should be directly above "C-$H_2O$"; |
| | line 29, | "aeruginose" should be --aeruginosa--; |
| | line 30, | "Controls" in Table 2(b) should be directly above "C-$H_2O$"; |
| Column 10, | lines 3 and 4, | "when bound to cotton regardless of the type of washing which is used" should not be italicized; |
| | lines 28 and 29, | Heading "Milligrams of Nitrogen per Gram of Cotton Expressed as Cyanuric Chloride and Antimicrobials" should be --Cyanuric Chloride and Antimicrobials Expressed as Milligrams of Nitrogen per Gram of Cotton--; |
| | line 30, | "Mg. n" should be --Mg. N--; |
| Column 11, | line 36, | "Controls" in Table 3(a) should be directly above "NaOH"; |
| | line 48, | "C-SMP-I" should be --C-SPM-1--; |
| | line 54, | "Controls" in Table 3(b) should be directly above "NaOH"; |
| Column 12, | line 4, | "Controls" in Table 3(c) should be directly above "NaOH"; |
| | line 23, | "Controls" in Table 3(d) should be directly above "NaOH"; |
| | lines 39 and 40, | Heading "Milligrams of Nitrogen per Gram of Cotton Expressed as Cyanuric Chloride and |

UNITED STATES PATENT OFFICE

CERTIFICATE OF CORRECTION

PATENT NO. : 4,035,146
DATED : July 12, 1977
INVENTOR(S) : Mortimer Wilkes Brenner and Louis Laufer It is certified that error appears in the above-identified patent and that said Letters Patent are hereby corrected as shown below:

| | |
|---|---|
| | Antimicrobials" should be --Cyanuric Chloride and Antimicrobials Expressed as Milligrams of Nitrogen per Gram of Cotton--; |
| Column 12, lines 41, 42, 43, | "Corrected for NaOH Blank Mg. N. per g. Cotton" should be --Mg. N. per g. Cotton (Corrected for NaOH Blank)--; |
| Column 13, line 13, | "S. diastaticus" should be italicized; |
| line 29, | "comes" should be --becomes--, |

Signed and Sealed this

*Sixth* Day of *December 1977*

[SEAL]

*Attest:*

RUTH C. MASON
*Attesting Officer*

LUTRELLE F. PARKER
*Acting Commissioner of Patents and Trademarks*